US008128008B2

(12) United States Patent
Chevalier

(10) Patent No.: US 8,128,008 B2
(45) Date of Patent: Mar. 6, 2012

(54) FLUID DISPENSER NOZZLE AND A FLUID DISPENSER DEVICE INCLUDING SUCH A NOZZLE

(75) Inventor: Marc Chevalier, Franconville (FR)

(73) Assignee: LVMH Recherche, Saint Jean de Braye (FR)

( * ) Notice: Subject to any disclaimer, the term of this patent is extended or adjusted under 35 U.S.C. 154(b) by 0 days.

(21) Appl. No.: 11/762,551

(22) Filed: Jun. 13, 2007

(65) Prior Publication Data

US 2008/0041884 A1 Feb. 21, 2008

(30) Foreign Application Priority Data

Jun. 21, 2006 (FR) ..... 06 05560

(51) Int. Cl.
*B05B 1/30* (2006.01)
*B05B 1/00* (2006.01)

(52) U.S. Cl. ..... 239/570; 239/569; 239/602; 239/461; 239/463; 222/520

(58) Field of Classification Search ..... 239/458, 239/459, 464, 492, 493–495, 497, 533.1, 239/533.13–533.15, 570, 546, 602, 569, 239/571, 461, 463, 482, 483; 222/380, 385, 222/520, 490–497
See application file for complete search history.

(56) References Cited

U.S. PATENT DOCUMENTS 4,081,879 A * 4/1978 Rubright ..... 16/2.2
4,182,496 A 1/1980 Burke
4,313,569 A * 2/1982 Burke ..... 239/333
4,387,879 A * 6/1983 Tauschinski ..... 251/149.1
4,561,570 A * 12/1985 Zulauf et al. ..... 222/153.14
5,769,325 A * 6/1998 Jouillat et al. ..... 239/337
5,836,484 A * 11/1998 Gerber ..... 222/494
5,842,616 A * 12/1998 Ruscitti et al. ..... 222/321.3

(Continued)

FOREIGN PATENT DOCUMENTS

EP 1 588 774 A 10/2005

(Continued)

OTHER PUBLICATIONS

French Preliminary Search Report FR 0605560; report dated Apr. 11, 2007.

(Continued)

*Primary Examiner* — Len Tran
*Assistant Examiner* — James Hogan
(74) *Attorney, Agent, or Firm* — Miller, Matthias & Hull, LLP

(57) ABSTRACT

A fluid dispenser nozzle comprising: a rigid support; a fluid passageway; and an annular sealing element that is made of elastomer, that surrounds the rigid support, and that is provided with a lip adapted to close off the passageway so long as the fluid is not arriving under pressure from said passageway. The fluid dispenser nozzle being wherein the rigid support comprises a side wall which internally defines the passageway, the side wall extending along a central axis, and wherein the rigid support further comprises an end wall which closes off the fluid passageway at the second end of the side wall, said end wall being provided with at least one hole that is covered by the lip of the sealing element.

12 Claims, 3 Drawing Sheets

U.S. PATENT DOCUMENTS

| | | | | |
|---|---|---|---|---|
| 5,855,322 | A | 1/1999 | Py | |
| 5,931,386 | A * | 8/1999 | Jouillat | 239/463 |
| 6,234,363 | B1 * | 5/2001 | Stradella | 222/402.12 |
| 6,386,395 | B1 * | 5/2002 | Lunghetti | 222/213 |
| 6,443,370 | B1 * | 9/2002 | Brulle et al. | 239/333 |
| 6,464,150 | B1 * | 10/2002 | Zimmer et al. | 239/284.1 |
| 6,722,585 | B1 * | 4/2004 | Stradella | 239/533.13 |
| 7,654,419 | B2 * | 2/2010 | Dobbs et al. | 222/321.9 |

FOREIGN PATENT DOCUMENTS

| | | | |
|---|---|---|---|
| GB | 1 247 947 | A | 9/1971 |
| WO | WO 00/26007 | A | 5/2000 |

OTHER PUBLICATIONS

United Kingdom Intellectual Property Office, "*British Search Report and Combined First Office Action*", Aug. 26, 2007, 5 Pages.

* cited by examiner

FIG. 1
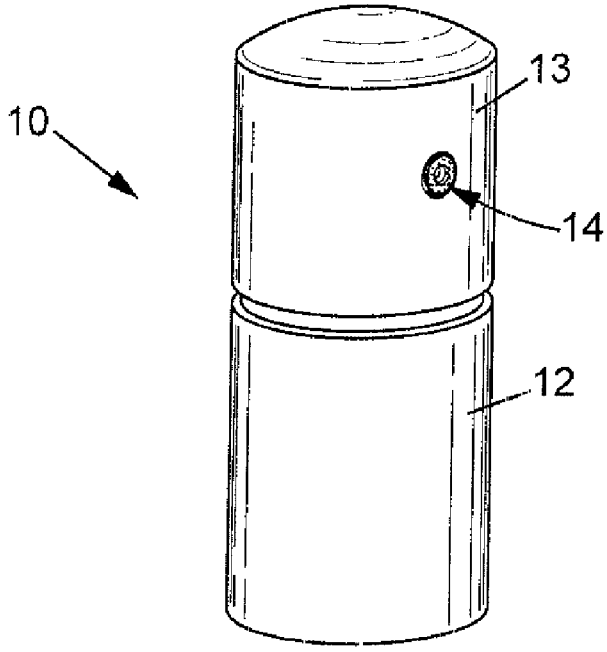
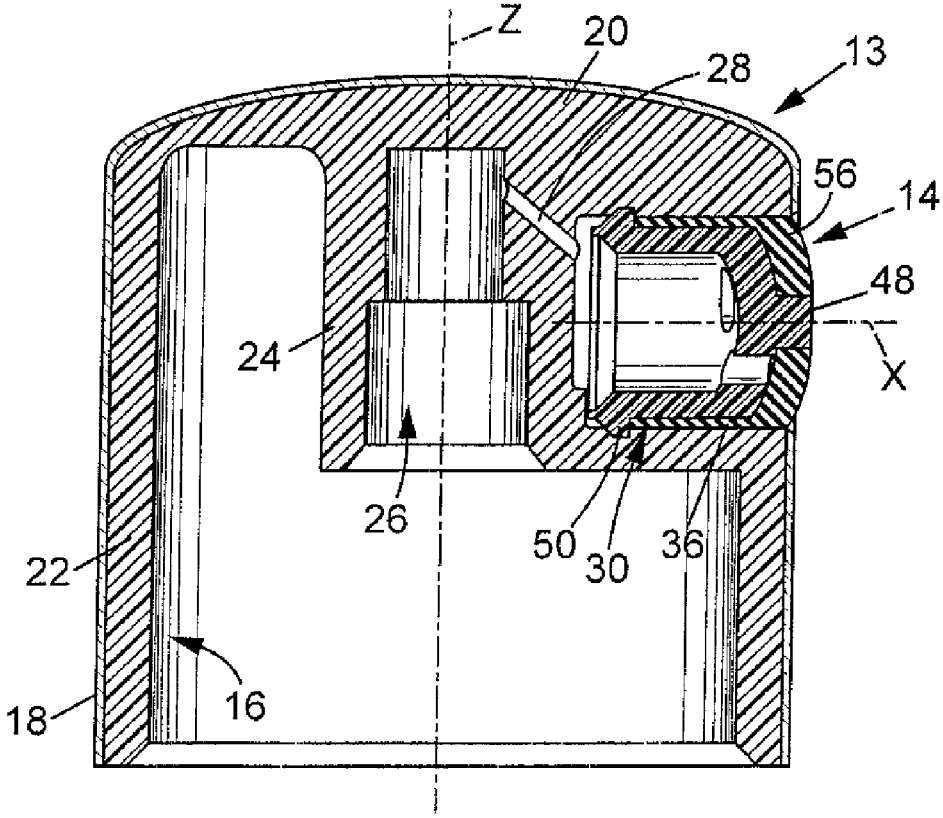
FIG. 2

FLUID DISPENSER NOZZLE AND A FLUID DISPENSER DEVICE INCLUDING SUCH A NOZZLE

FIELD OF THE DISCLOSURE

The present invention relates to fluid dispenser nozzles and to dispenser devices including such nozzles.

BACKGROUND OF THE DISCLOSURE

More particularly, the invention relates to a fluid dispenser comprising a rigid support, a fluid passageway which passes through the rigid support, and an annular sealing element that is made of elastomer, that surrounds the rigid support, and that is provided with a lip adapted to close off the passageway so long as the fluid is not arriving under pressure from said passageway.

Document WO-A-00 26007 describes an example of such a dispenser nozzle, in which the support and the sealing element co-operate to define an outlet passageway.

Unfortunately, the dispenser nozzle described in that document suffers from the following drawback: the sealing element is held on the support of the nozzle at only one end of said sealing element.

SUMMARY OF THE DISCLOSURE

According to the invention, a dispenser nozzle of the type in question being wherein the rigid support the rigid support comprises a side wall which is annular in shape and which internally defines the fluid passageway, the side wall extending between first and second ends along a central axis, and wherein the rigid support further comprises an end wall which closes off the fluid passageway at the second end of the side wall, said end wall being provided with at least one hole that is covered by the lip of the sealing element.

By means of these features, the sealing element is tight-fitting over the entire outside surface of the side wall of the support, thereby enabling said sealing element to be held more securely on the support. In addition, the sealing element is always subjected to a certain amount of elastic pre-stress due to shrinkage after cooling, thereby guaranteeing that it is tight-fitting for the purpose of holding it on the support.

In addition, the sealing element is molded directly over the side wall and over the end wall of the support, thereby making it easier to manufacture the nozzle.

In various embodiments of the device of the invention, it is optionally also possible to use one or more of the following features:

the first end of the side wall is provided with at least one tab that projects radially outwards;

the sealing element covers the side wall of the support from the first end to the second end, and is provided with at least one slot through which the tab projects outwards; these features make it possible to reinforce the coupling between the sealing element and the support with a mechanical coupling;

the first end of the side wall is provided with a plurality of tabs projecting radially outwards and distributed angularly over the side wall;

the end face is provided with an outwardly projecting stud and the sealing element covers the end wall in a manner such that, when the stud is in the closed position, it fills a central opening defined by the lip of the sealing element;

the end face is provided with three holes angularly distributed around the stud;

the sealing element is molded over the support;

the support is made of a thermoplastic material and the sealing element is made of a thermoelastic material that does not adhere to the thermoplastic material of the support; and the support is made of polybutylene terephthalate, and the sealing element is made of thermoelastic silicone.

The invention also provides a fluid dispenser device including: a dispenser head provided with a fluid channel opening out in a nozzle recess having an annular wall and open to the outside; and a dispenser nozzle engaged in said nozzle recess, the sealing element being adapted to be held by compression between the annular wall of the recess and the support.

BRIEF DESCRIPTION OF THE DRAWINGS

Other characteristics and advantages of the invention appear from the following description of two embodiments thereof, given by way of non-limiting example and with reference to the accompanying drawings In the drawings:

FIG. 1 is a perspective view of an example of a first embodiment of a dispenser device of the invention;

FIG. 2 is a vertical section view of the dispenser head of the device of FIG. 1;

MORE DETAILED DESCRIPTION

Figure 3:
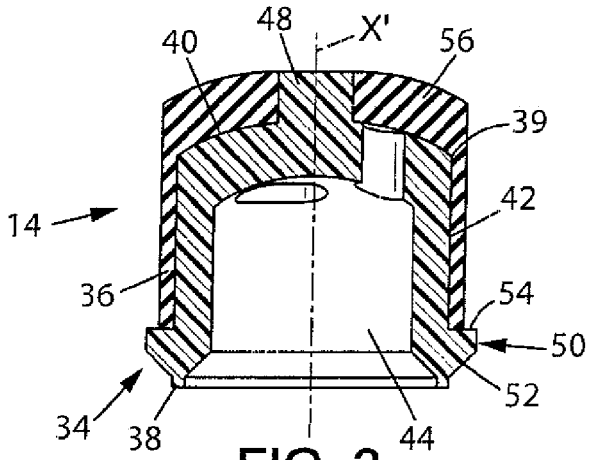
FIG. 3 is a detail view in axial section through the nozzle equipping the dispenser head of FIG. 2.
Figure 4:
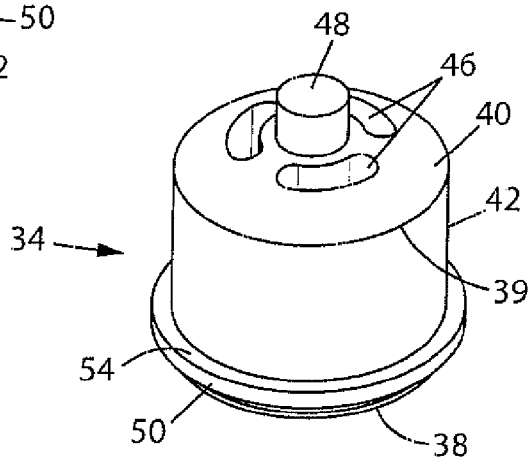
FIG. 4 is a perspective view of the dispenser nozzle of the invention, without the sealing element.
Figure 5:
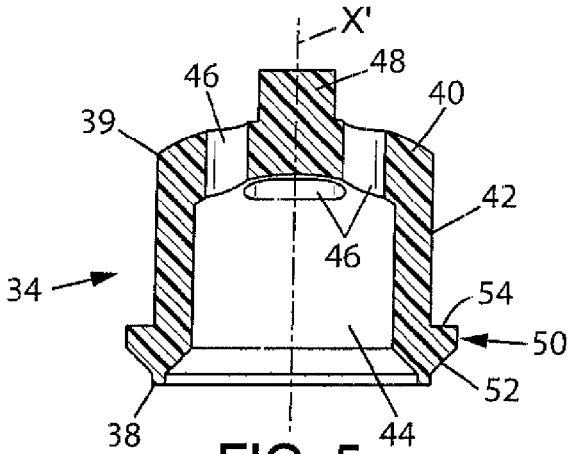
FIG. 5 is a vertical section view of the nozzle of FIG. 4.
Figure 6:
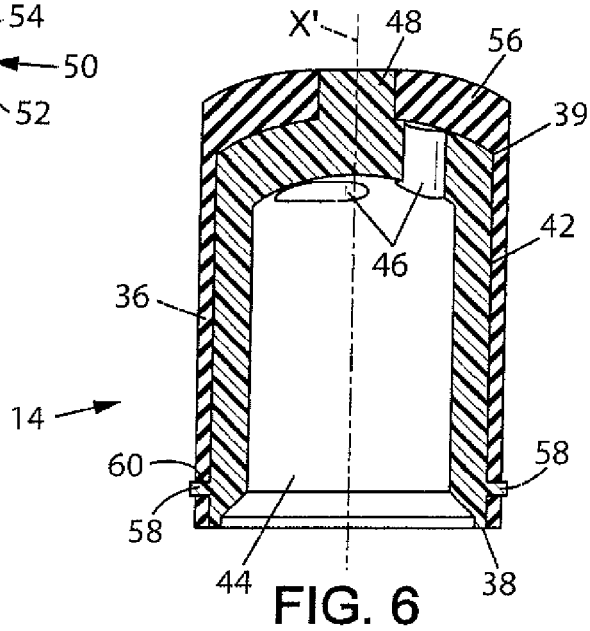
FIG. 6 is a view similar to the FIG. 3 view of a second embodiment of a nozzle.
Figure 7:
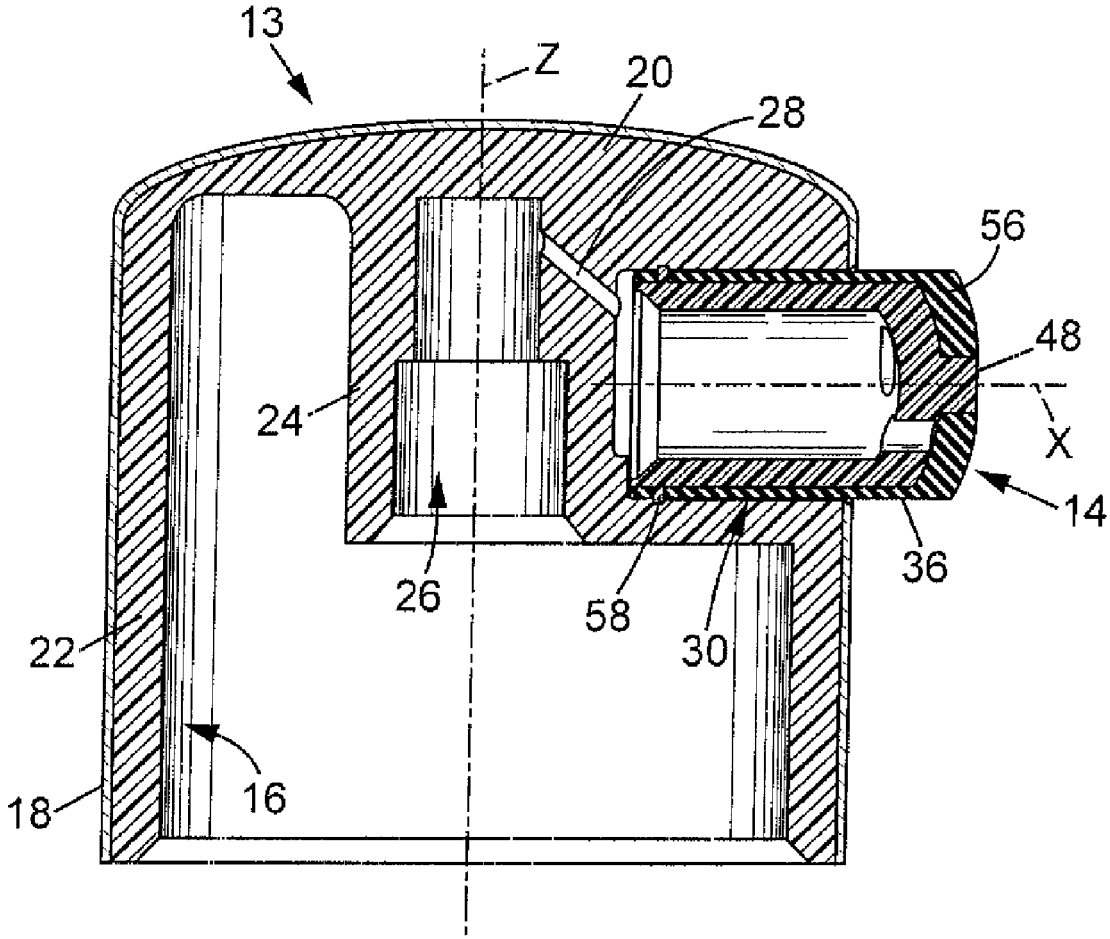
FIG. 7 is a vertical section view of the dispenser head of the device with a nozzle as shown in FIG. 6.

FIG. 1 shows a fluid dispenser device 10 designed, for example, to dispense a cosmetic or the like, in particular having a liquid or semi-liquid consistency.

The dispenser device 10 comprises a reservoir 12 containing fluid, optionally under pressure, and a dispenser head 13 or pusher element carried by the reservoir 12 and provided with a nozzle 14 adapted to allow fluid to be delivered with a view to it being used.

As shown in FIG. 2, the dispenser head 13 has a body 16 which can, for example, be molded in one piece of a thermoplastic synthetic material, in particular of polypropylene or the like. The body 16 is covered with decorative trim 18 that is metal or otherwise.

For example, said body 16 can comprise a top face 20 (which is convex in the example considered herein) and a substantially cylindrical skirt 22 centered on a substantially vertical axis Z. At the centre of the skirt 22, the body 16 of the head can further comprises a tubular wall 24 that extends downwards about the axis Z from the top face 20 to a free end, while defining an internal well 26 into which a hollow actuating rod of a pump or of a valve (not shown) can, for example, be engaged.

The well 26 communicates via a fluid channel 28 with a nozzle recess 30 which opens out outwards along a central axis X that can, for example be substantially perpendicular to the axis Z (the axis X could also be inclined). For example, the nozzle recess 30 can have a substantially circularly cylindrical shape centered on the axis X.

As shown in FIG. 3, the nozzle 14 comprises a support 34 and a sealing element 36.

The support 34 is molded in one piece of a plastics material, in particular of a thermoplastic material, e.g. of polybutylene terephthalate (PBT).

The support 34 can be annular in shape, and, more particularly, can be in the shape of a generally cylindrical sleeve centered on an axis X', and extending from a first end 38 to a second end 39. The support 34 comprises an annular side wall 42 and an end wall 40 disposed at the second end 30. The end wall 40 extends in a plane that is substantially perpendicular to the central axis X. The annular side wall 42 internally defines a passageway 44 formed in the support. Said passageway 44 opens out into three holes 46 provided in the end wall 40.

The end wall 40 is also provided with a stud 48. The stud 48 is circularly symmetrical about the central axis X' and extends axially outwards. The holes 46 are distributed angularly about the stud 48.

In the vicinity of the first end 38, the side wall 42 of the support can be provided with an annular rim 50 that projects radially outwards. For example, the rim 50 can have a rear face 52 that converges radially inwards and a front face 54 that is substantially perpendicular to the axis X'.

The sealing element 36 can be made of an elastomer (thermoelastic material) chosen so that said sealing element 36 does not adhere to the material of the support 34 merely due to it being molded thereover. For example, the sealing element 36 can be made of thermoelastic silicone, in particular of a Liquid Silicone Rubber (LSR).

In the example considered herein, the sealing element 36 has an annular shape and is molded over the side wall 42 of the support 34. In this position, because of the phenomenon of the sealing element 36 shrinking as it cools, said sealing element fits tightly against the side wall 42, thereby holding it more securely on the support 34. The sealing element 36 is further provided with a lip 56 in elastic abutment against the end wall 40 of the support 34. The holes 46 provided in the end wall 40 are covered by the lip 56 of the sealing element, thereby preventing the fluid from stagnating and drying in the holes 46 between occasions on which the device is used.

The stud 48 and the sealing element 36 are made such that, when the fluid is not under pressure, the lip 56 of the sealing element 36 bears against the end wall 40 and the stud 48 fills a central opening defined by the lip 56 of the sealing element. Preferably, when the fluid is not under pressure, the outer end of the stud 48 and the lip 56 of the sealing element form of a substantially plane surface.

The thickness of the sealing element covering the end wall 40 is approximately in the range 0.3 millimeters (mm) to 0.5 mm, i.e. a thickness adapted to provide sealing for the passageway 44 in the nozzle relative to the outside, and to be suitable for being displaced to enable the fluid to be delivered, as described below.

The nozzle is engaged by force in the recess 30 in the dispenser head 13, in a manner such that the central axis X' of the nozzle substantially coincides with the central axis X of the recess. The sealing element 36 is thus in direct contact with the material of the body of the dispenser head 13. The sealing element 36 is engaged between a wall of the body 16 of the dispenser head 13 and the side wall 42 of the support 34. During this engagement, the annular rim 50 of the support 34 locally deforms the material of the body 16, which material is more flexible than the material of the support. This engagement is facilitated by the shape of the rim 50 which anchors into the material of the body of the head, thereby holding the nozzle 14 stationary.

The above-described device operates as follows. At rest, the sealing element 36 closes off, in airtight manner, the holes 46 terminating the fluid passageway 44, thereby preventing said fluid from drying inside the dispenser head 13 and inside the nozzle 14. When the user presses manually on the head 13, such pressing causes the hollow rod of a pump or of a valve that is mounted on the reservoir 12 to move downwards, thereby causing the fluid to be delivered under pressure through the well 26, through the channel 28, and through the passageway 44 of the nozzle 14, so that the lip 56 of the sealing element moves elastically away from the stud 48, thereby allowing the fluid to pass. At the end of delivery of the fluid, the sealing element 36 returns immediately to bear against the end wall 40.

In a second embodiment of the invention, the support is provided with at least one tab 58 that projects radially outwards. For example, the support can be provided is with three tabs distributed angularly over the side wall, and the sealing element 36 covers the side wall 42 of the support from the first end 38 to the second end 40. The sealing element is provided with slots 60 through which the tabs 58 project outwards. By means of these features, the sealing element 36 is held simply and securely on the support 34 because the sealing element is prevented from moving in translation along the axis X'. In addition, the tabs 58 can act as additional fastening means for fastening the nozzle in the nozzle recess 30 by affording a mechanical coupling constituted by the tabs anchoring in the material of the body of the dispenser head, as described above for the rim 50 of the nozzle.

What is claimed is:

1. A fluid dispenser nozzle comprising:

a rigid support;

a fluid passageway which passes through the rigid support; and an annular sealing element that is made of elastomer, that surrounds the rigid support, and that is provided with a lip adapted to close off the passageway so long as the fluid is not arriving under pressure from said passageway;

said fluid dispenser nozzle being wherein the rigid support comprises a side wall which is annular in shape and which internally defines the passageway, the side wall extending between first and second ends along a central axis; and wherein the rigid support further comprises an end wall which closes off the fluid passageway at the second end of the side wall, the end wall is provided with an outwardly projecting stud and in which the sealing element covers the end wall in a manner such that, when the stud is in the closed position, it fills a central opening defined by the lip of the sealing element, the end wall is provided with three holes angularly distributed around the stud.

2. A dispenser nozzle according to claim 1, in which the first end of the side wall is provided with at least one tab that projects radially outwards.

3. A dispenser nozzle according to claim 2, in which the sealing element covers the side wall of the support from the first end to the second end, and is provided with at least one slot through which the tab projects outwards.

4. A dispenser nozzle according to claim 2, in which the first end of the side wall is provided with a plurality of tabs projecting radially outwards and distributed angularly over the side wall.

5. A dispenser nozzle according to claim 1, in which the end wall is provided with an outwardly projecting stud and in which the sealing element covers the end wall in a manner such that, when the stud is in the closed position, it fills a central opening defined by the lip of the sealing element.

6. A nozzle according to claim 5, in which the end wall is provided with three holes angularly distributed around the stud.

7. A nozzle according to claim 1, in which the support is made of polybutylene terephthalate, and the sealing element is made of thermoelastic silicone.

8. A fluid dispenser device including:

a dispenser head provided with a fluid channel opening out in a nozzle recess having an annular wall and open to the outside; and a dispenser nozzle according to claim 1, which dispenser nozzle is engaged in said nozzle recess.

9. A device according to claim 8, in which the support of the nozzle is provided with an annular rim that projects radially outwards, and in which said support of the nozzle is engaged directly in the dispenser head, and is held by the rim anchoring into the dispenser head after penetrating through the wall of the nozzle recess.

10. A device according to claim 8, in which the first end of the side wall is provided with at least one tab that projects radially outwards, and in which the nozzle is held by the tabs anchoring into the dispenser head after penetrating through the wall of the nozzle recess.

11. A device according to claim 8, in which the dispenser head is provided with metal outer trim.

12. A dispenser nozzle according to claim 1, wherein the sealing element is molded over the support, the support being made of a thermoplastic material and the sealing element being made of a thermoelastic material that does not adhere to the thermoplastic material of the support when molded over said support, said thermoelastic material causes the sealing element to shrink on the support when said sealing element cools after being molded over the support so that said sealing element is held securely on the support by tight fitting of the sealing element against the side wall.

* * * * *